US005286938A

United States Patent [19]

Takei et al.

[11] Patent Number: 5,286,938

[45] Date of Patent: Feb. 15, 1994

[54] HIGH FREQUENCY HEATING APPARATUS

[75] Inventors: Tamotsu Takei, Seto; Hisao Karino, Kaniehonmachi, both of Japan

[73] Assignee: Kabushiki Kaisha Toshiba, Kawasaki, Japan

[21] Appl. No.: 716,019

[22] Filed: Jun. 17, 1991

[30] Foreign Application Priority Data

Jul. 24, 1990 [JP] Japan ..... 2-195823

[51] Int. Cl.[5] ..... H05B 6/68

[52] U.S. Cl. ..... 219/715; 219/718; 363/19; 363/98

[58] Field of Search ..... 219/10.55 B, 10.55 R, 219/10.55 F, 10.55 A, 10.55 D, 10.55 M, 10.41; 363/98, 19, 37, 97

[56] References Cited

U.S. PATENT DOCUMENTS 4,882,666 11/1989 Bruning et al. ..... 219/10.55 B
4,888,461 12/1989 Takano et al. ..... 219/10.55 B
4,900,885 2/1990 Inumada ..... 219/10.55 B
4,920,246 4/1990 Aoki ..... 219/10.55 B
4,967,051 10/1990 Maehara et al. ..... 219/10.55 B

FOREIGN PATENT DOCUMENTS 52-57541 5/1977 Japan ..... H05B 9/06
52-79345 7/1977 Japan ..... H05B 9/06

*Primary Examiner*—Geoffrey S. Evans
*Assistant Examiner*—Tu Hoang
*Attorney, Agent, or Firm*—Limbach & Limbach

[57] ABSTRACT

A high frequency heating apparatus such as microwave ovens includes an inverter circuit having a switching element and converting a commercial ac power supply to a high frequency power supply by controlling "on" and "off" periods of the switching element, a magnetron driven by the inverter circuit, a counter cumulatively counting an operating period of time and a deenergization period of time of the magnetron, and a compensator for compensating an "on" period of the switching element based on a count value of the counter so that an input power to the inverter circuit is rendered constant.

9 Claims, 2 Drawing Sheets

HIGH FREQUENCY HEATING APPARATUS

BACKGROUND OF THE INVENTION

This invention relates to a high frequency heating apparatus such as microwave ovens including a magnetron supplied with a variable ac output from an inverter circuit to drive the same.

A high frequency output from a magnetron is varied with variation of an input voltage or commercial power supply voltage in conventional high frequency heating apparatus, which variation of the high frequency output ill affects the cooking.

To overcome the above-described disadvantage, the inventors have considered an arrangement that a magnetron anode current is detected and an "on" period of a switching element of an inverter circuit is controlled so that the magnetron anode current is rendered constant, thereby maintaining the magnetron high frequency output at a predetermined value.

On the other hand, it takes some period of time for the magnetron to cool down by way of heat dissipation after completion of the cooking. Consequently, when another cooking is initiated without a sufficient period of time after the previous cooking, an initial temperature of the magnetron at the time of initiation of the cooking differs from case to case in accordance with a lapse of time after completion of the previous cooking. Thus, when the magnetron initial temperature at the time of the cooking initiation differs, a mode of the subsequent raise in the magnetron temperature differs from case to case. A magnet (usually, a ferrite magnet) of the magnetron is demagnetized as the temperature of the magnetron anode is raised and consequently, the strength of a magnetic field between the anode and cathode is reduced, resulting in drop of the anode voltage. Consequently, the input power and accordingly, the high frequency output are increased and decreased depending upon the anode temperature or anode voltage when the anode current is controlled to be constant as described above. Accordingly, the gross calorific value to the food to be cooked differs between the case where the magnetron temperature is low and the case where the magnetron temperature is high even when the cooking period of time is the same, resulting in variations in the degree of finishing of the cooked food. Moreover, since the magnetron temperature is raised with lapse of time after the cooking initiation, the anode voltage drops. Consequently, the high frequency output is gradually reduced during the cooking, which prevents the heating power from being constant means for resetting the counter to an initial value thereof when a first high frequency heating operation is initiated after the power supply is put to work, and subsequently, causing the counter to start the counting operation.

SUMMARY OF THE INVENTION

Therefore, an object of the present invention is to provide a high frequency heating apparatus wherein the high frequency output can be stabilized and a uniform finishing of the cooked food can be obtained.

The magnetron temperature at the time of the heating initiation is varied depending upon the previous heating period of time and the subsequent magnetron deenergization period of time. Further, the magnetron temperature during the heating operation is raised with lapse of the heating operation period. Thus, the magnetron temperature has some relations to the magnetron operating and deenergization periods and vice versa.

Relying upon these relations, the present invention provides a high frequency heating apparatus comprising an inverter circuit having a switching element and converting a commercial ac power supply to a high frequency power supply by controlling "on" and "off" periods of the switching element, a magnetron driven by the inverter circuit, a counter cumulatively counting an energization period of time and a deenergization period of time of the magnetron, means for compensating a count-up quantity of the counter per counting operation in accordance with a high frequency output from the magnetron compensation means for compensating the "on" period of the switching element based on a count value of the counter so that an input power to the inverter circuit is rendered constant means for resetting the counter to an initial value thereof when a first high frequency heating operation is initiated after the power supply is put to work, and subsequently, causing the counter to start the counting operation.

The magnetron energization and deenergization periods are cumulatively counted by the counter. The "on" period of the switching element of the inverter circuit is compensated by the compensation means based on the count value so that the input power to the inverter circuit is rendered constant, thereby stabilizing the high frequency output.

The temperature rise rate of the magnetron is varied when the high frequency output of the magnetron is adjusted. Preferably, a count-up quantity per counting operation or a counting cycle may be compensated in accordance with the high frequency output of the magnetron. Consequently, an inverter input power can be controlled in accordance with the adjusted high frequency output or the variation of the magnetron temperature rise rate.

It is generally considered that the magnetron is sufficiently cool at the time the power supply is put to work. Accordingly, when the counter is arranged to start its counting operation at the time a first high frequency heating operation is initiated after turn-on of a power switch of the apparatus with an initial count value set therein at the time of initiation of the first high frequency heating operation, the deviation in the relation between the count value of the counter and the actual magnetron temperature can be solved every time the power supply is put to work. Consequently, a high control accuracy can be maintained.

Furthermore, the counter may be provided with suitable upper and lower limit count values corresponding to upper and lower limit values of a range of change of the magnetron temperature respectively. Consequently, the relationship that the magnetron temperature is high when the count value is large and the magnetron temperature is low when the count value is small can be maintained.

The counter may comprise an up-down counter. Further, the "on" period of the switching element may be compensated stepwise every time the count value of the counter reaches a predetermined value. Consequently, the control manner can be simplified.

Other objects of the present invention will become obvious upon understanding of the illustrative embodiment about to be described or will be indicated in the appended claims. Various advantages not referred to herein will occur to one skilled in the art upon employment of the invention in practice.

BRIEF DESCRIPTION OF THE DRAWINGS

For a better understanding of the invention, reference may be had to the following description taken in conjunction with the accompanying drawings, in which.

DESCRIPTION OF THE PREFERRED EMBODIMENT

Figure 1:
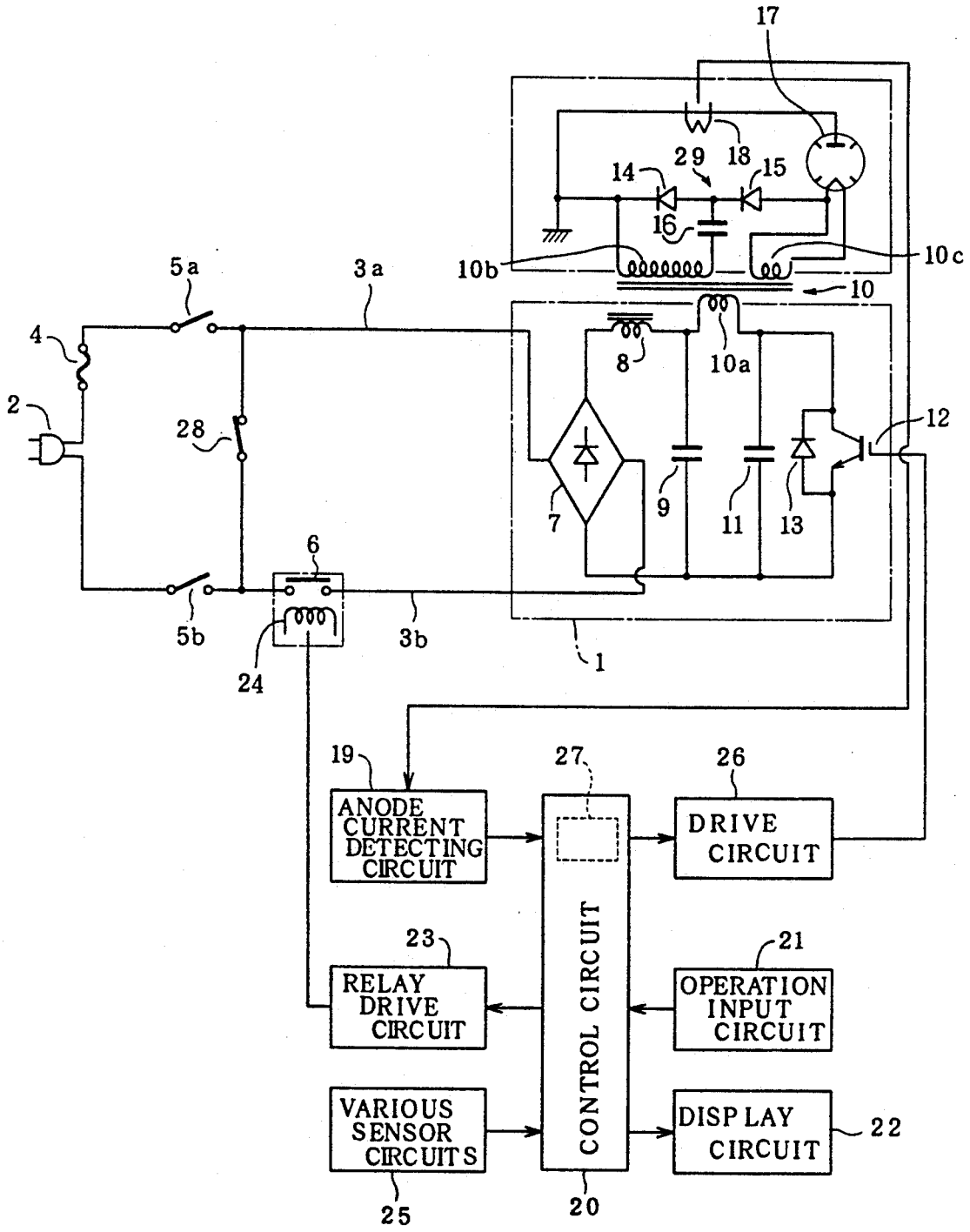
FIG. 1 is an electrical circuit diagram of the high frequency heating apparatus of one embodiment in accordance with the present invention.

One embodiment of the present invention will be described with reference to the accompanying drawings.

An inverter circuit 1 of a high frequency heating apparatus is supplied with an ac power from a commercial power supply via ac bus lines 3*a* and 3*b* connected to a power supply plug 2. A fuse 4 and a first door switch 5*a* are connected in series to the bus line 3*a*. A second door switch 5*b* and a relay switch 6 are connected in series to the other bus line 3*b*. A short-circuiting switch 28 is connected between the bus lines 3*a*, 3*b*. The short-circuiting switch 28 is turned on when a door (not shown) of the high frequency heating apparatus is opened. If both switches 5*a*, 5*b* should be shorted, opening the door would turn on the short-circuiting switch 28, thereby preventing the operation of the inverter circuit 1.

The inverter circuit 1 comprises a full-wave rectifier circuit 7, a choke coil 8, a smoothing capacitor 9, a primary winding 10*a* of a high-voltage transformer 10, a resonance capacitor 11, a switching element 12 (an insulated gate bipolar transistor, in the embodiment) and a flywheel diode 13. A high frequency current is generated at the primary winding 10*a* of the transformer 10 by turning on and off the switching element 12 such that a high frequency voltage is generated at secondary windings 10*b* and 10*c*. A voltage doubler rectifier circuit 29 comprising two diodes 14 and 15 and a capacitor 16 is connected to the secondary winding 10*b* of the transformer. A high frequency high voltage is applied across an anode and cathode of a magnetron 17 via the voltage doubler rectifier circuit 16. A voltage induced at the other secondary winding 10*c* is applied to the cathode of the magnetron 17.

A current transformer 18 for detecting an anode current is connected across an anode side power supply path. An output signal from the current transformer 18 is processed by an anode current detecting circuit 19 and then, supplied to a control circuit 20. The control circuit 20 receives an operation input from an operation input circuit 21 to operate a display circuit 22 so that the operation content is displayed by the display circuit 22. The control circuit 20 also controls a relay drive coil 24 via a relay drive circuit 23 so that the relay drive coil 24 is energized and deenergized. The control circuit 20 further controls the operation of the magnetron 17 based on output information from various sensor circuits 25 and the switching element 12 via a switching element drive circuit 26 so that the switching element 12 is turned on and off.

An up-down counter serving as a counter 27 is incorporated in the control circuit 20. The counter 27 counts up during operation of the magnetron 17 and counts down during stop of the magnetron 17 so that operating and deenergization periods of the magnetron 17 are cumulatively counted by the counter 27. The counter 27 is arranged so that a count-up quantity per counting operation is compensated in accordance with the high frequency output from the magnetron 17 as shown in TABLE 1. In this case a counting cycle is fixed at one second.

TABLE 1

| High frequency output (W) | Count-up quantity |
|---|---|
| 600 | 10 |
| 500 | 9 |
| 400 | 8 |
| 300 | 7 |
| 0 | −5 (down count) |

As shown in TABLE 1, the count-up quantity per counting operation is reduced as the high frequency output is decreased. The reason for this is that the temperature rise rate of the magnetron 17 is lowered as the high frequency power is decreased. Further, since the temperature of the magnetron is decreased by way of heat dissipation during deenergization of the magnetron, the counter counts down by the quantity of 5. The above-described counting operation of the counter 27 is continuously performed while the power supply is being put to work or a power switch (not shown) is turned on. However, the counter 27 is provided with an upper limit count value so that when the magnetron 17 temperature is saturated with lapse of an operating period of time, the count-up operation is interrupted. The counter 27 is also provided with a lower limit count value. The magnetron temperature is not decreased below the room temperature no matter how long the deenergization period of the magnetron is. Accordingly, the lower limit count value is set to "0" over which value the count-down operation is not performed. As the result of the above-described counting manner, it can be reasoned that the magnetron temperature is high when the count value is large and the magnetron temperature is low when the count value is small.

Since it can be considered that the magnetron is sufficiently cool when the electric power is applied to the high frequency heating apparatus, the counter 27 is arranged to start its counting operation with an initial value of "0" at the time the first high frequency heating operation is initiated after the power supply is put to work. Consequently, the deviation in the relation between the count value of the counter and the actual magnetron temperature can be solved every time the power switch of the high frequency heating apparatus is turned on. In this case the control circuit 20 serves as compensation means for compensating the "on" period of the switching element based on the count value of the counter 27. The anode current of the magnetron 17 is automatically adjusted by the compensating operation of the compensation means so that the input power to the inverter circuit 1 is rendered constant. More specifically, when the magnetron 17 is sufficiently cool or when the count value of the counter 27 is "0," the minimum anode current $I_{min}$ is set at the value which is 90% of the maximum anode current $I_{max}$ when the magnetron temperature is sufficiently high and then, the high frequency heating operation is initiated. During the high frequency heating operation, the anode current is increased stepwise so as to take the values which are 92%, 94%, 96%, 98% and 100% of the maximum anode current $I_{max}$ sequentially every time the count value of the counter 27 is increased by a predetermined value or the temperature of the magnetron 17 is raised by a predetermined value.

Figure 2:
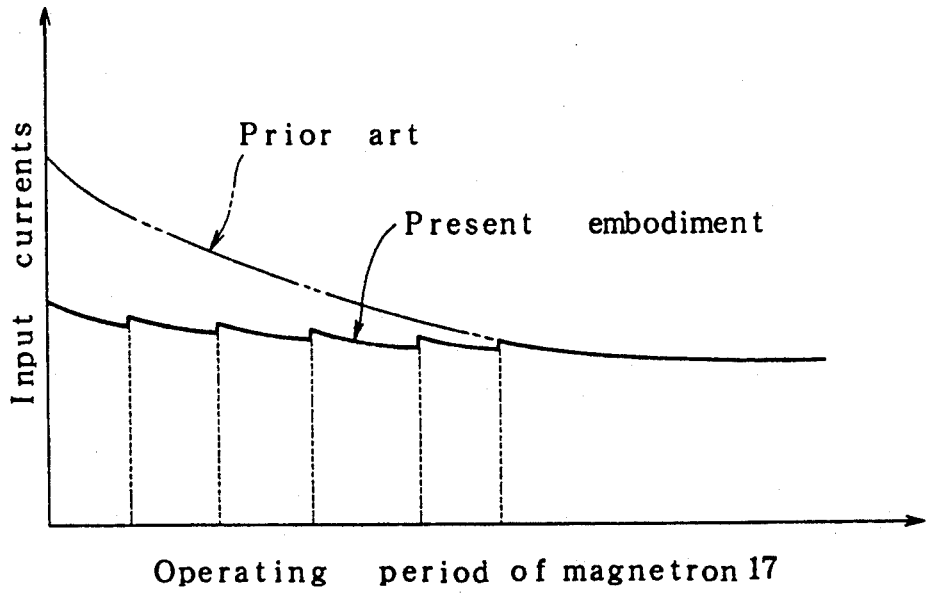
FIG. 2 is a graph showing changes of the input currents with time.

The initial temperature of the magnetron 17 at the time of start of the heating operation differs from case to case depending upon the lapse of time from the completion of the previous heating operation. Accordingly, when the magnetron initial temperature differs from case to case, the mode of the subsequent rise of the magnetron temperature also differs from case to case. Additionally, the magnetron temperature is raised during the heating operation, too. When the magnetron anode temperature is high in such a condition, a magnet (usually, a ferrite magnet) of the magnetron 17 is demagnetized and consequently, the strength of a magnetic field between the anode and cathode is reduced, resulting in drop of the anode voltage. Consequently, when the input power to the inverter circuit 1 is controlled so that the magnetron anode current is rendered constant irrespective of the temperature of the magnetron 17, the changes of the magnetron temperature cause the inverter input current to vary as shown by a two-dot chain line in FIG. 2. The inverter input current is substantially proportional to the product of the magnetron anode voltage and current. The above-described reduction in the input current to the inverter causes fall of the input power, resulting in reduction of the high frequency power from the magnetron 17.

In accordance with the above-described embodiment, however, the counter 27 starts the counting operation with the initial value of "0" at the time the first high frequency heating operation is initiated after turn-on of the power switch, and the counter 27 counts up in a predetermined cycle (1 second, for example) during the heating operation. In this case the count-up quantity per counting operation is reduced as the high frequency output from the magnetron 17 is reduced as shown in TABLE 1, so that the count value takes a value in accordance with the rise of the temperature of the magnetron 17. As the result of the counting operation as described above, the anode current is increased stepwise so as to take the values which are 92%, 94%, 96%, 98% and 100% of the maximum anode current $I_{max}$ sequentially every time the count value of the counter 27 is increased by a predetermined value or the temperature of the magnetron 17 is raised by a predetermined value. Consequently, the input current to the inverter 1 is rendered constant as shown by a solid line in FIG. 2, thereby stabilizing the high frequency output.

When the cooking is completed with deenergization of the magnetron 17, the counter 27 subsequently counts down by the count-up quantity of 5 from the count value at the time of the cooking completion, in the predetermined cycle (1 second, for example). The count value is rendered small with lapse of period in which the magnetron 17 is deenergized such that such a reduction in the count value corresponds to the reduction of the magnetron 17 temperature after completion of the heating operation. Accordingly, when the subsequent heating operation is initiated, the count value of the counter 27 at the time of start of the heating operation corresponds to the temperature of the magnetron 17 at that time. Subsequently, the counter 27 counts up in the predetermined cycle with lapse of the heating period of time in the same manner as described above. The magnetron 17 anode current is gradually increased in accordance with the count value so that the input current to the inverter circuit 1 and accordingly, the high frequency output from the magnetron 17 are stabilized.

As described above, the counter 27 counts down from the count value at the time of completion of the previous heating operation in the predetermined cycle even when the initial temperature of the magnetron 17 at the time of start of the heating operation differs depending upon the lapse of time after the completion of the previous heating operation and the mode of the subsequent rise of the magnetron temperature or the variation of the magnetron anode voltage differs if the initial temperature of the magnetron differs. Since the count value at the time of start of the succeeding heating operation corresponds to the temperature of the magnetron at that time, the input power to the inverter 1 can be controlled with the magnetron initial temperature at the time of start of the heating operation taken into consideration. Consequently, the high frequency output can be stabilized even when the cooking operations are continuously performed again and again.

The above-described count-up and count-down operations of the counter 27 are repeatedly performed during turn-on of the power switch with the respective initiation and interruption of the heating operation. The temperature of the magnetron is saturated with lapse of some period of time to be rendered constant Accordingly, when the count value reaches the upper limit value corresponding to the saturation temperature, the count-up operation of the counter 27 is interrupted subsequently. Further, the count value of the counter 27 reaches the lower limit value (0) when the magnetron 17 is sufficiently cooled during its deenergization such that the magnetron temperature is rendered approximately constant (at the room temperature). The count-down operation is interrupted subsequently. Thus, the relation that the magnetron temperature is high when the count value is large and the magnetron temperature is low when the count value is small can be maintained.

Moreover, since it can be considered that the magnetron is sufficiently cool at the time the power supply is put to work, the counter 27 is starts its counting operation with an initial value of "0" when the first high frequency heating operation is initiated after the power supply is put to work, as described above. Consequently, the deviation in the relation between the count value of the counter and the actual magnetron temperature can be solved every time the power switch is turned on. Thus, the control accuracy can be further maintained at the high level.

Furthermore, since the count-up interval of the counter 27 is shortened as the high frequency output is reduced, a most suitable control of the inverter input power can be performed in accordance with the changes of the magnetron temperature rise rate with adjustment of the high frequency output. The control accuracy can be further improved. Alternatively, the counting cycle of the counter 27 may be changed in accordance with the high frequency output with its adjustment, as shown in TABLE 2, instead of the count-up interval. In this case the count-up quantity per counting operation takes the value of 10 and the count-down quantity per counting operation the value of 5, for example.

TABLE 2

| High frequency output (W) | Counting cycle (second) |
|---|---|
| 600 | 1.0 |
| 500 | 1.1 |

TABLE 2-continued

| High frequency output (W) | Counting cycle (second) |
|---|---|
| 400 | 1.3 |
| 300 | 1.4 |
| 0 (deenergized) | 2.0 |

Although the insulated gate bipolar transistor is employed as the switching element 12 in the foregoing embodiment, other switching elements such as metal oxide semiconductor field-effect transistors (MOSFET) may be employed instead.

Although the up-down counter is employed as the counter 27 in the foregoing embodiment, the energization and deenergization periods of the magnetron 17 may be individually counted cumulatively and the obtained cumulative value of the magnetron deenergization period may be subtracted from the cumulative value of the magnetron energization period when the cooking is started, thereby obtaining the count value corresponding to the magnetron temperature a t the time the cooking is started. Subsequently, the energization period of the magnetron 17 may be counted with the above count value as the initial value.

The foregoing disclosure and drawings are merely illustrative of the principles of the present invention and are not to be interpreted in a limiting sense. The only limitation is to be determined from the scope of the appended claims.

We claim:

1. A high frequency heating apparatus comprising:

a) an inverter circuit having a switching element and converting an ac power supply to a high frequency power supply by controlling "on" and "off" periods of the switching element;

b) a magnetron driven by the inverter circuit;

c) a control circuit including a counter cumulatively counting an energization period of time and a deenergization period of time of the magnetron, the control circuit generating a signal to control an on-off operation of the switching element of the inverter circuit; and d) a drive circuit driving the switching element in response to the signal from the control circuit;

wherein the control circuit further includes first means for compensating a count-up quantity of the counter per counting operation in accordance with the heating power from the magnetron, second means for compensating the "on" period of the switching element based on a count valve of the counter so that an input power to the inverter circuit is rendered constant, and third means for causing the counter to start the counting operation from an initial value thereof when a first high frequency heating operation is initiated after the power supply is put to work.

2. A high frequency heating apparatus according to claim 1, wherein the counter starts the counting operation at the time of initiation of a first high frequency heating operation after an electrical power is applied to the high frequency heating apparatus with an initial count valve set therein at the time of initiation of the first high frequency heating operation.

3. A high frequency heating apparatus according to claim 1, wherein the counter is provided with upper and lower limit count values corresponding to upper and lower limit values of a range of change of the magnetron temperature respectively.

4. A high frequency heating apparatus according to claim 1, wherein the counter comprises an up-down counter.

5. A high frequency heating apparatus according to claim 1, wherein the first and second compensation means compensates the "on" period of the switching element stepwise every time the count value of the counter counts up by a predetermined value during the high frequency heating operation.

6. A high frequency heating apparatus comprising:

a) an inverter circuit having a switching element and converting an ac power supply to a high frequency power supply by controlling "on" and "off" periods of the switching element;

b) a magnetron driven by the inverter circuit;

c) a control circuit including a counter cumulatively counting an energization period of time and a deenergization period of time of the magnetron, the control circuit generating a signal to control an on-off operation of the switching element of the inverter circuit;

d) a drive circuit driving the switching element in response to the signal from the control circuit; and wherein the control circuit further includes first means for compensating a count-up quantity of the counter per counting operation in accordance with the heating power from the magnetron, second means for compensating the "on" period of the switching element based on a count value of the counter so that an input power to the inverter circuit is rendered constant, and third means for causing the counter to start the operation from an initial value thereof when a first high frequency heating operation is initiated after the power supply is put to work

7. A high frequency heating apparatus according to claim 6, wherein the counter is provided with upper and lower limit count values corresponding to upper and lower limit values of a range of change of the magnetron temperature respectively.

8. A high frequency heating apparatus according to claim 6, wherein the counter comprises an up-down counter.

9. A high frequency heating apparatus according to claim 6, wherein the first and second compensation means compensates the "on" period of the switching element stepwise every time the count value of the counter counts up by a predetermined value during the high frequency heating operation.

* * * * *